US008870349B2

(12) United States Patent
Koizumi

(10) Patent No.: US 8,870,349 B2
(45) Date of Patent: Oct. 28, 2014

(54) ADAPTOR

(71) Applicant: Seiko Epson Corporation, Tokyo (JP)

(72) Inventor: Yoshihiro Koizumi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/722,032

(22) Filed: Dec. 20, 2012

(65) Prior Publication Data

US 2013/0208051 A1 Aug. 15, 2013

(30) Foreign Application Priority Data

Dec. 20, 2011 (JP) ..... 2011-278734

(51) Int. Cl.
*B41J 2/14* (2006.01)
*B41J 2/16* (2006.01)
*B41J 2/175* (2006.01)

(52) U.S. Cl.
CPC ..... *B41J 2/17526* (2013.01); *B41J 2/17553* (2013.01); *B41J 2/17546* (2013.01); *B41J 2/1752* (2013.01)
USPC ..... 347/50

(58) Field of Classification Search
None
See application file for complete search history.

(56) References Cited

U.S. PATENT DOCUMENTS 5,860,363 A 1/1999 Childers et al.
6,130,695 A * 10/2000 Childers et al. ..... 347/85
7,128,380 B2 * 10/2006 Hatasa et al. ..... 347/7
7,677,710 B2 * 3/2010 Kobayashi et al. ..... 347/85
7,806,523 B2 * 10/2010 Seino et al. ..... 347/86
8,007,084 B2 8/2011 Kobayashi et al.
2009/0295885 A1 12/2009 Wanibe
2010/0134574 A1 6/2010 Kobayashi et al.
2011/0279587 A1 11/2011 Kobayashi et al.

FOREIGN PATENT DOCUMENTS

JP 10-202900 A 8/1998
JP 2006-224529 A 8/2006
JP 2009-285890 A 12/2009
JP 2011-042127 A 3/2011
WO 2006-082836 A1 8/2006

* cited by examiner

*Primary Examiner* — Stephen Meier
*Assistant Examiner* — Renee I Wilson
(74) *Attorney, Agent, or Firm* — Nutter McClennen & Fish LLP; John J. Penny, V.; Rory P. Pheiffer

(57) ABSTRACT

An adaptor includes an adaptor main body capable of being mounted with respect to a liquid accommodation body mounting portion of a printer to which an ink cartridge configured to accommodate ink is mounted in an attachable or detachable manner; a memory cell MC that is updated by a control portion of the printer, and maintains information about whether or not the printing operation is possible in the printer; an electrical terminal that is used in communication between the memory cell and the printer; and an operation button that outputs an update signal that updates information about whether or not the printing operation is possible to information permitting the printing operation of the printer with respect to the memory cell, when the information about whether or not the printing operation is possible maintained in the memory cell does not permit the printing operation of the printer.

16 Claims, 13 Drawing Sheets

ADAPTOR

TECHNICAL FIELD

The present invention relates to an adaptor capable of being mounted with respect to a liquid accommodation body mounting portion of a liquid ejecting apparatus to which a liquid accommodation body configured to accommodate liquid is mounted.

BACKGROUND ART

From the related art, for example, liquid ejecting apparatuses have been practically used which eject ink as a kind of the liquid from a liquid ejecting head with respect to paper as a kind of medium to print images including characters and figures. This kind of apparatus supplies the ink to the liquid ejecting head serving as a consumption portion configured to consume the ink from an ink cartridge (a liquid accommodation body) accommodating the ink through supply needles (supply members) inserted into the ink cartridge. Moreover, printing is performed and the ink is consumed by ejecting the supplied ink to the paper from the liquid ejecting head. Thus, this kind of liquid ejecting apparatus is also a liquid consumption apparatus.

In the liquid ejecting apparatus as the liquid consumption apparatus, when performing a relatively large quantity of printing, in order to continuously and stably supply the ink to the liquid ejecting head, it has been suggested to supply the ink from an ink tank serving as a liquid accommodation body having an accommodation capacity of ink that is greater than that of the ink cartridge. For example, PTL 1 discloses a configuration in which an attachment is mounted to a cartridge holder and is connected to the supply needle serving as the supply member of the ink provided in the liquid ejecting apparatus so that the ink is supplied from outside via an ink supply tube.

CITATION LIST

Patent Literature

[PTL 1] JP-A-2006-224529

SUMMARY OF INVENTION

Technical Problem

In the case of the configuration disclosed in PTL 1, the ink is continuously supplied by the attachment that can be replaced with the ink cartridge so as to supply the ink. Furthermore, as a configuration that more simply and continuously supplies the ink from the outside, a configuration is also considered in which the ink supply tube is directly connected to the supply needle without going through the attachment.

However, in the liquid ejecting apparatus, when the ink cartridge is mounted to the cartridge holder, predetermined information (for example, identification data of the ink cartridge and residual quantity data of the ink) stored in a memory cell included in the ink cartridge is read. Furthermore, if the read information shows that the ink cartridge is mounted and a predetermined amount of ink or more is present in the mounted ink cartridge, the printing operation, that is, the ejecting operation of the ink is permitted.

However, as in PTL 1, in the configuration that supplies the ink via the attachment or by directly connecting the ink supply tube to the supply needle, since the predetermined information of the memory cell is updated by a control portion of the liquid ejecting apparatus, the predetermined information permitting the printing operation may not be continuously maintained. As a result, even if an amount of liquid greater than that of the ink accommodated in the ink cartridge can be continuously supplied, it is would be possible for the predetermined information permitting the printing operation to be updated, and the ejecting operation may not be performed on the liquid ejecting apparatus.

Accordingly, the present invention has been made in order to solve the above-mentioned problems, and an object thereof is to provide an adaptor capable of performing the ejecting operation of the liquid by being mounted to the liquid accommodation body mounting portion.

Solution To Problem

In order to solve the above-mentioned object, there is provided an adaptor that includes an adaptor main body capable of being mounted with respect to a liquid accommodation body mounting portion of a liquid ejecting apparatus to which a liquid accommodation body configured to accommodate liquid is mounted in an attachable or detachable manner; a memory cell that is provided in the adaptor main body, is updated by a control portion of the liquid ejecting apparatus, and maintains information about whether or not the printing operation is possible in the liquid ejecting apparatus; an electrical terminal that is used in communication between the memory cell and the liquid ejecting apparatus; and an update signal output portion that outputs an update signal that updates information about whether or not the printing operation is possible to information permitting the printing operation of the liquid ejecting apparatus with respect to the memory cell, when the information about whether or not the printing operation is possible maintained in the memory cell does not permit the printing operation of the liquid ejecting apparatus.

According to this configuration, in the liquid ejecting apparatus, the ejecting operation of the liquid can be performed by the adaptor mounted to the liquid accommodation body mounting portion.

In the adaptor of the invention, the update signal output portion includes a displacement member that outputs the update signal by displacement operation.

According to this configuration, the displacement member is subjected to the displacement operation by a simple operation such as pressing the displacement member to cause the update signal output portion to function, and thus the ejecting operation of the liquid can be performed.

In the adaptor of the invention, a plurality of liquid accommodation bodies is mounted to the liquid ejecting apparatus in an attachable or detachable manner, and electrical terminals corresponding to the plurality of liquid accommodation bodies are provided.

According to this configuration, in regard to the liquids each supplied by the plurality of liquid accommodation bodies mounted to the liquid ejecting apparatus, the ejecting operation of the liquids can be performed.

In the adaptor of the invention, in the adaptor main body, one electrical terminal is provided with a plurality of update signal output portions.

According to this configuration, for example, in the adaptor main body, one of the plurality of update signal output portions can be selected to perform the ejecting operation of the liquid.

In the adaptor of the invention, the update signal output portion is provided in the adaptor main body.

According to this configuration, since the adaptor main body includes the update signal output portion, the ejecting operation of the liquid can be performed simply by the adaptor mounted to the liquid accommodation body mounting portion.

In the adaptor of the invention, the adaptor main body is provided with a supply port configured to supply the liquid to the supply member supplied with the liquid from the liquid accommodation body when being mounted to the liquid accommodation body mounting portion, and the update signal output portion is provided at a position at an opposite side in an insertion direction when the adaptor main body is mounted to the liquid accommodation body mounting portion, with respect to the supply port.

According to the configuration, it is possible to provide the update signal output portion at an operable position in the adaptor main body in the state where the adaptor main body is mounted to the liquid accommodation body mounting portion.

In the adaptor of the invention, the adaptor main body is provided with a hollow-shaped portion that is depressed in a direction intersecting with the detachment direction in which the adaptor main body mounted to the liquid accommodation body mounting portion is detached, and the update signal output portion is provided in the hollow-shaped portion.

According to the configuration, for example, since the update signal output portion can be provided so as not to project from the external form of the adaptor main body, the interference between the adaptors can be suppressed in the state where the adaptor is mounted to the liquid accommodation body mounting portion.

In the adaptor of the invention, the adaptor main body is provided with a main body surface portion, a normal direction of which faces in the detachment direction in which the adaptor main body mounted to the liquid accommodation body mounting portion is detached, and the update signal output portion is provided in the main body surface portion.

According to the configuration, by providing the update signal output portion in the main body surface portion in which the normal line faces in the detachment direction, the update signal output portion can be easily operated from a space area formed on the detachment direction side.

In the adaptor of the invention, the adaptor main body has a first surface and a second surface. A normal direction of the first surface faces in the detachment direction in which the adaptor main body mounted to the liquid accommodation body mounting portion is detached, and the first surface is the nearest in the detachment direction when being mounted to the liquid accommodation body mounting portion. The second surface is contiguous with the first surface, and a normal direction of the second surface extends from a set of facing surfaces facing each other in a direction intersecting with the detachment direction to the direction intersecting with the detachment direction. The update signal output portion is provided on the second surface.

According to the configuration, since the update signal output portion is provided on the surface contiguous with the first surface provided further away in the detachment direction, the update signal output portion can be easily operated from the detachment direction side.

In the adaptor of the invention, the adaptor main body is provided with at least an opening portion that is opened in the detachment direction in which the adaptor main body mounted to the liquid accommodation body mounting portion is detached, and the update signal output portion is provided in the opening portion.

According to the configuration, it is possible to easily operate the update signal output portion from the space area formed on the detachment direction side via the opening portion.

BRIEF DESCRIPTION OF DRAWINGS

FIG. 1 is a perspective view of a printer according to an embodiment related to the present invention.

FIG. 2 is a structural perspective view of a state where an apparatus case is partially detached in regard to an aspect of directly supplying the ink from an ink supply tube in the printer of the embodiment.

FIG. 3 is a perspective view that illustrates an adaptor to be mounted in an aspect in which the ink supply tube is directly connected to a supply needle.

FIG. 4 is a schematic cross-sectional view that illustrates the adaptor mounted in the state where the ink supply tube is directly connected to the supply needle.

FIG. 5 is a structural perspective view of a state where the apparatus case is partially detached in the aspect of supplying the ink via the adaptor in the printer of the embodiment.

FIG. 6 is a schematic cross-sectional view that illustrates the adaptor mounted in the state where a supply port of the adaptor is connected to the supply needle.

FIG. 9 is a modified example of the adaptor and is a perspective view that illustrates a state where the operation button is placed in a hollow-shaped portion of an adaptor main body.

FIG. 12 is a modified example of the adaptor and is a cross-sectional view that illustrates a state where an update signal output portion is a displacement portion provided in the adaptor main body.

DESCRIPTION OF EMBODIMENTS

Hereinafter, as an embodiment embodying the present invention, an ink jet type printer (simply also referred to as a "printer"), which is a multi-function printer including an image reading device adapted to read images, as a liquid ejecting apparatus configured to print images or the like while ejecting and consuming the ink serving as an example of the liquid to paper serving as an example of a medium from a liquid ejecting head, will be described with reference to the drawings.

Figure 1:
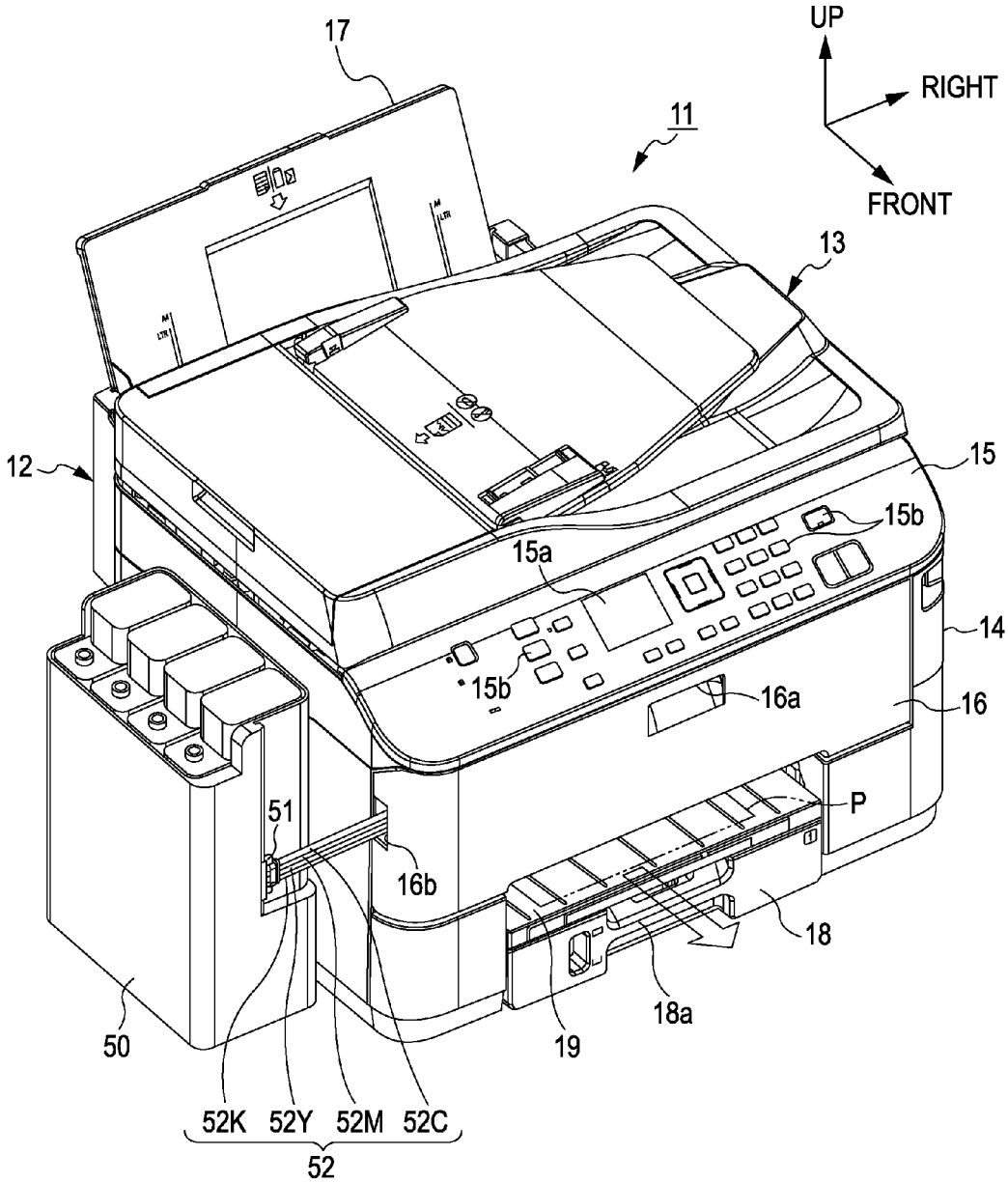
[FIG. 1]

As illustrated in FIG. 1, a printer 11 includes an apparatus main body 12, and a scanner unit 13 as an image reading device that is connected and equipped in an anti-gravitational direction (upward) to the apparatus main body 12. The apparatus main body 12 is constituted by an apparatus case 14 as the case including a plurality of members, and a consumption portion 20 (see FIG. 2) configured to eject and consume the ink to the paper P or the like is included in the apparatus case 14.

In the apparatus case 14, on the forward upper side serving as the discharging direction of the printed paper P, an operation panel 15 operated by a user when operating the printer 11 is placed. The operation panel 15 includes a display portion 15*a* (for example, a liquid crystal display) for displaying a menu screen or the like, and various operation buttons 15*b* provided around the display portion 15*a*.

Furthermore, in the apparatus case 14, a front cover 16 is attached below the operation panel 15 in an openable and closable manner. The front cover 16 is opened forward by a rotary mechanism such as a hinge (not illustrated) provided below the front cover 16. In addition, in the front cover 16, a gripping portion 16*a* for holding by a user when opening or closing the front cover 16 is depressed. Furthermore, in the apparatus case 14, a paper discharging table 19 configured to discharge the paper P discharged from the apparatus main body 12 to the outside of the apparatus main body 12 is disposed below the front cover 16.

The printer 11 includes a paper feeding cassette 18 configured to place the paper P below the paper discharging table 19 in a laminating state. The uppermost accommodated and laminated pieces of paper P are sent to a transport path (not illustrated) formed in the apparatus main body 12 one by one, and are transported to a consumption portion 20. In addition, the paper feeding cassette 18 can be inserted into or extracted from the apparatus main body 12. On a front side of the paper feeding cassette 18, an eaves-shaped gripping portion 18*a* for holding by a user when extracting the paper feeding cassette 18 from the apparatus main body 12 is formed, whereby the paper feeding cassette 18 is easily extracted forward from the apparatus main body 12. Furthermore, a placing tray 17 configured to place the paper P is provided on the rear side of the apparatus main body 12, and the paper P placed on the placing tray 17 is sent to the transport path (not illustrated) formed in the same apparatus main body 12 and is transported to the consumption portion 20.

Furthermore, in the printer 11, on the left outside when viewed from the front in the apparatus main body 12, an ink tank 50 as a liquid accommodation body configured to accommodate the ink consumed by the consumption portion 20 is included in an abutment state or a non-abutment state with respect to the apparatus case 14. The ink tank 50 accommodates four kinds of ink (each color ink of cyan ink, magenta ink, yellow ink and black ink in the present embodiment). Moreover, each color ink of cyan ink, magenta ink, yellow ink and black ink is supplied into the apparatus main body 12 using ink supply tubes 52C, 52M, 52Y and 52K functioning as flow paths of each ink via a connection terminal 51. In addition, in the following description, when generically naming the ink supply tubes 52C, 52M, 52Y and 52K without distinction, the ink supply tube is referred to as an ink supply tube 52.

Figure 2:
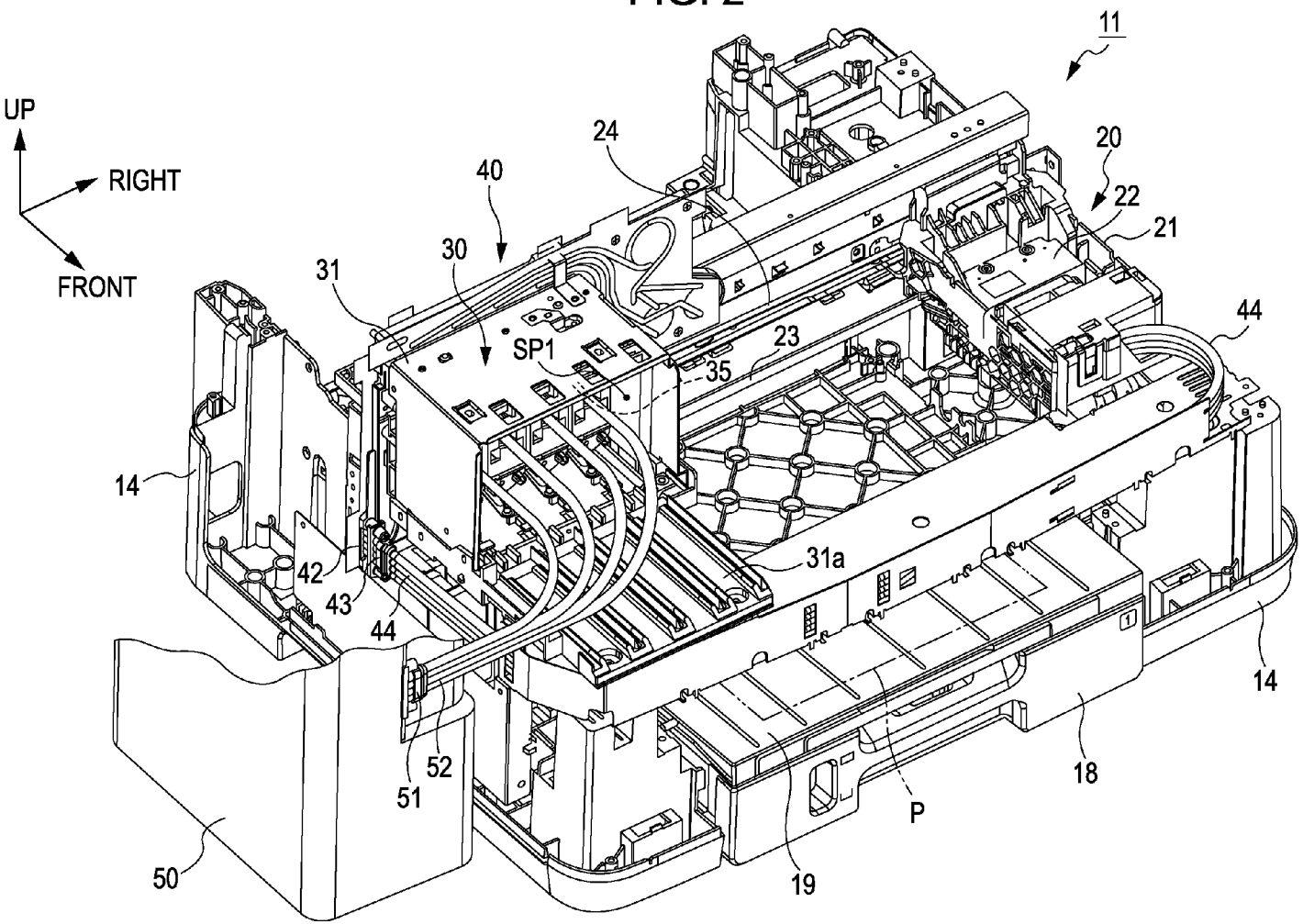
[FIG. 2]

As illustrated in FIG. 2, the apparatus main body 12 includes a liquid accommodation body mounting portion 30 to which an ink cartridge 55 (see FIG. 3) as a liquid accommodation body (not illustrated) adapted to accommodate the liquid is mounted in an attachable or detachable manner, and a flow path forming portion 40 disposed behind the liquid accommodation body mounting portion 30. The liquid accommodation body mounting portion 30 includes a guide portion 31*a* by which the ink cartridge 55 is guided at the time of mounting, and a substantially box-like cartridge holder 31 having a space area SP1, the front of which is opened and into which the ink cartridge is inserted. The cartridge holder 31 includes a supply needle 35 (see FIG. 3) as a supply member, which is inserted when the ink cartridge 55 is mounted and to which the ink accommodated in the ink cartridge 55 is introduced, on the internal rear backside thereof in a direction serving as the insertion direction of the ink cartridge 55 into the space area SP1.

The ink introduced and supplied to the supply needle 35 flows in a flowing path (not illustrated) of the ink formed in the flow path forming portion 40 disposed behind the liquid accommodation body mounting portion 30. The flowing path is provided with a flowing mechanism (not illustrated) that includes, for example, a flow path pump such as a diaphragm pump, a check valve or the like to cause the ink to flow in one direction. By the operation of the flowing mechanism, each ink is sent to the ink supply tube 44 from a flow path terminal 42 provided at an end of a flow path in a downstream direction via a connection terminal 43 connected to the flow path terminal 42, when assuming the supply needle 35 to be at upstream side in the flow path forming portion 40.

Each ink sent to the ink supply tube 44 is supplied to a liquid ejecting head 22 via a carriage 21 connected to the downstream side end portion at an opposite side to the connection terminal 43 in the ink supply tube 44, and is ejected to the paper P from the liquid ejecting head 22 at the time of the movement of the carriage 21, whereby images or the like are printed.

That is, a guide shaft 23 is built which extends along a width direction (a horizontal direction) intersecting with a discharging direction of the paper P in the apparatus main body 12. Furthermore, the carriage 21 is supported by the guide shaft 23 in the state of being movable along the horizontal direction. A part of the carriage 21 is fixed to a belt 24 moved along with the driving of a carriage motor (not illustrated), and the carriage 21 reciprocates along the horizontal direction serving as a scanning direction along with the movement of the belt 24. The liquid ejecting head 22 configured to eject the ink with respect to the paper P is supported by the carriage 21. Moreover, the liquid ejecting head 22 is moved by moving the carriage 21, and the images or the like are printed on the paper P by ejecting the ink from nozzles (not illustrated) provided on a lower surface of the moving liquid ejecting head 22. Thus, in the present embodiment, in this manner, the carriage 21 and the liquid ejecting head 22 moving in the scanning direction correspond to the consumption portion 20.

Figure 5:
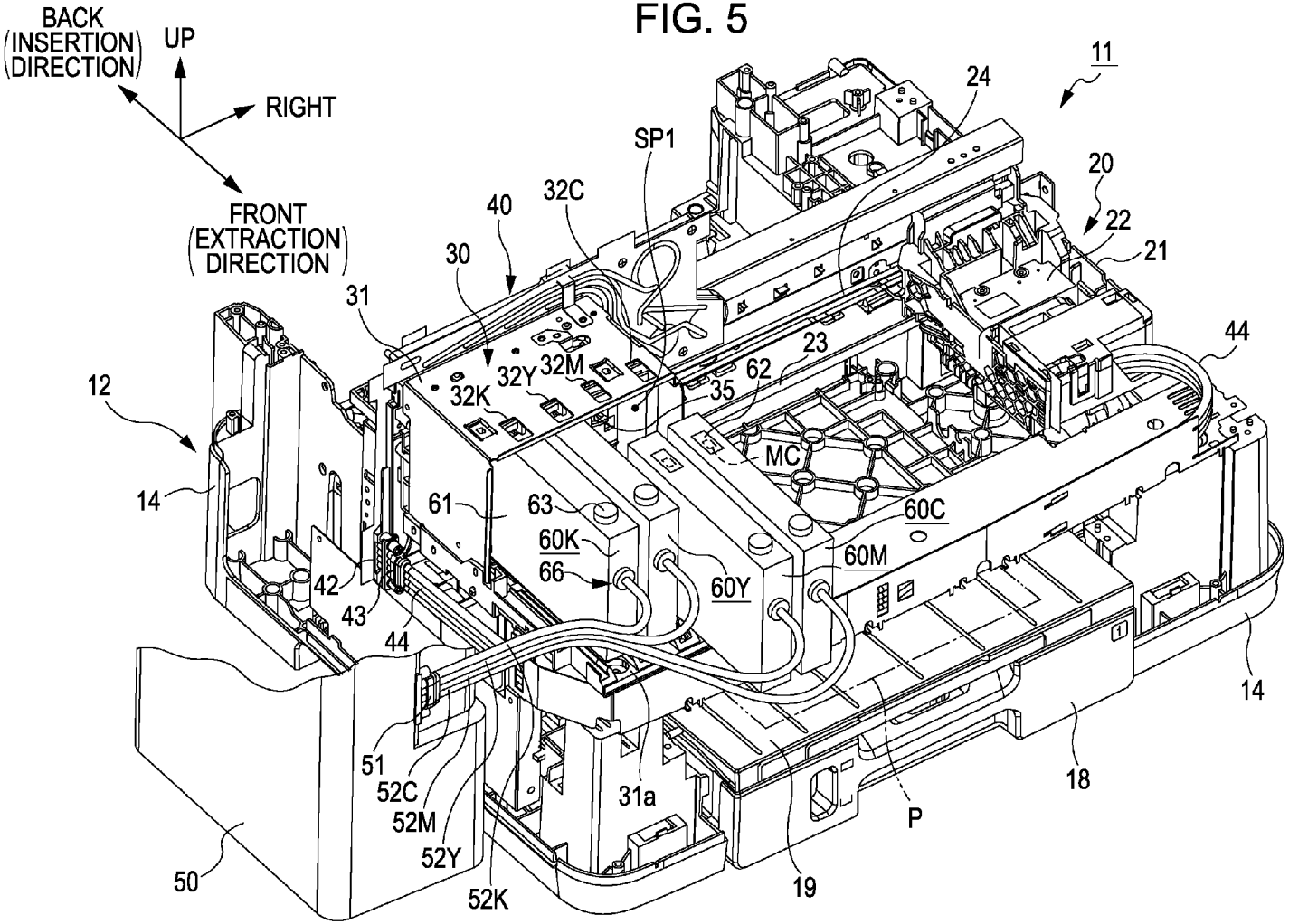
[FIG. 5]

In the printer 11 of the present embodiment, instead of the ink cartridge, the ink may be supplied to the supply needle 35 from the ink tank 50 configured to accommodate a large capacity of ink greater than in the ink cartridge. Moreover, in supplying the ink to the supply needle 35 from the ink tank 50, an adaptor of different aspect may be used. That is, as illustrated in FIG. 2, an adaptor 60 of an aspect of supplying the ink to the supply needle 35 without going through the adaptor, and, as shown in FIG. 5, an adaptor 60 of an aspect of supplying the ink to the supply needle 35 via the adaptor may be used.

First, the adaptor 60 of the aspect of supplying the ink to the supply needle 35 without going through the adaptor will be described with reference to FIGS. 2 to 4.

As illustrated in FIG. 2, in the printer 11, each ink supplied from the ink tank 50 is supplied to the supply needle 35 via the ink supply tube 52 directly connected to the supply needle 35 provided in the liquid accommodation body mounting portion 30. In this manner, the adaptor 60 used in the aspect of supplying the ink will be described with reference to FIG. 3. In addition, for convenience of explanation, FIG. 3 illustrates the ink supply tube 52C in the state before being connected to the supply needle 35.

Figure 3:
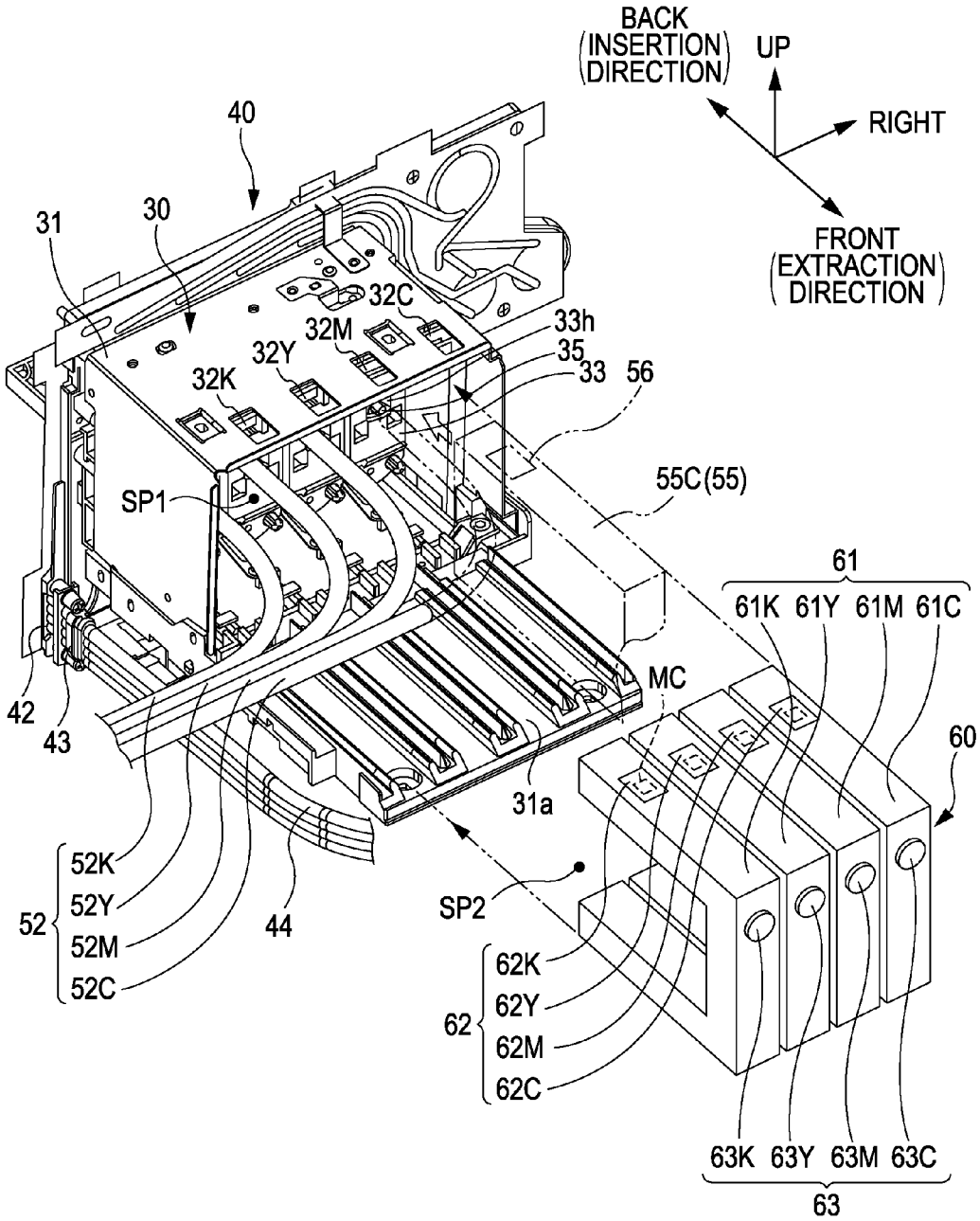
[FIG. 3]

As illustrated in FIG. 3, the supply needle 35 is located so as to face an opening hole 33*h* provided in a rear wall 33 in the space area SP1 of the liquid accommodation body mounting portion 30, communicates with the flowing path formed in the flow path forming portion 40 through which each ink flows, and is provided in response to each ink in the liquid accommodation body mounting portion 30. In addition, for example, when the ink cartridge 55C (a two-dot chain line in FIG. 3) as the liquid accommodation body is inserted and mounted to the liquid accommodation body mounting portion 30 as illustrated by an outline arrow, the rear wall 33 is moved rearward, and the supply needle 35 is configured so as to be inserted into the ink cartridge 55C to be mounted. By the insertion of the supply needle 35, the ink (herein, the cyan ink) accommodated in the ink cartridge 55C flows in the flow path forming portion 40 via the supply needle 35.

However, when the ink is supplied from the ink cartridge 55, in the printer 11, the communication of predetermined information (for example, identification data of the ink cartridge 55, and data of residual quantity of the ink or the like) is performed between a memory portion 56 constituted by a circuit board or the like included in the ink cartridge 55 and a control portion (not illustrated) of the printer 11. That is, in the present embodiment, as illustrated in FIG. 3, electrical terminals 32C, 32M, 32Y and 32K configured to communicate the information between the respective ink cartridges are provided over the cartridge holder 31. Moreover, when the ink cartridge is mounted, the control portion communicates the predetermined information between the memory portions 56 included in each ink cartridge 55 via the electrical terminals 32C, 32M, 32Y and 32K, and the ejecting operation of the ink from the liquid ejecting head 22 is permitted based on the communicated information. That is, the control portion performs the printing operation to the paper P in the consumption portion 20 and updates the information stored in the memory portions 56 in each ink cartridge.

For this reason, when connecting the ink supply tube 52 to the supply needle 35 to supply the ink from the ink tank 50, there is a need to communicate the information about whether or not the ejecting operation of the ink is possible with respect to the electrical terminals 32C, 32M, 32Y and 32K. If the communicated information about the ejecting operation of the ink permits the ejecting operation, the ejecting operation is permitted. However, since the information about whether or not the ejecting operation of the ink is possible is updated by a control portion (not illustrated) of the printer 11, when the information about whether or not the ejecting operation of the ink is possible is updated so as not to permit the ejecting operation by the update, even in a state where the ink can be continuously supplied from the ink tank 50, the ejecting operation of the ink is not permitted, and the printing operation of the printer 11 is not performed. Thus, there is a need to update the information about whether or not the ejecting operation of the ink is possible to the information permitting the ejecting operation of the ink, so that the printing operation of the printer 11 is performed. Thus, as illustrated in FIG. 3, adaptors 60C, 60M, 60Y and 60K capable of being mounted instead of each ink cartridge 55 are mounted to the liquid accommodation body mounting portion 30. In addition, in the following description, when not discriminating the adaptors 60C, 60M, 60Y and 60K, the adaptor is called an adaptor 60.

For example, each adaptor 60 can be mounted to the cartridge holder 31 instead of each ink cartridge 55 such as the ink cartridge 55C accommodating the cyan ink. Furthermore, each adaptor 60 has adaptor main bodies 61C, 61M, 61Y and 61K having shapes in which part of a substantially rectangular parallelepiped shape has been removed so that a space portion SP2 opened rearward is provided in the central portion so as not interfere with the ink supply tube 52 connected to the supply needle 35 at the time of mounting. In addition, in the following description, when not discriminating the adaptor main bodies 61C, 61M, 61Y and 61K, the adaptor main body is called an adaptor main body 61.

Figure 4:
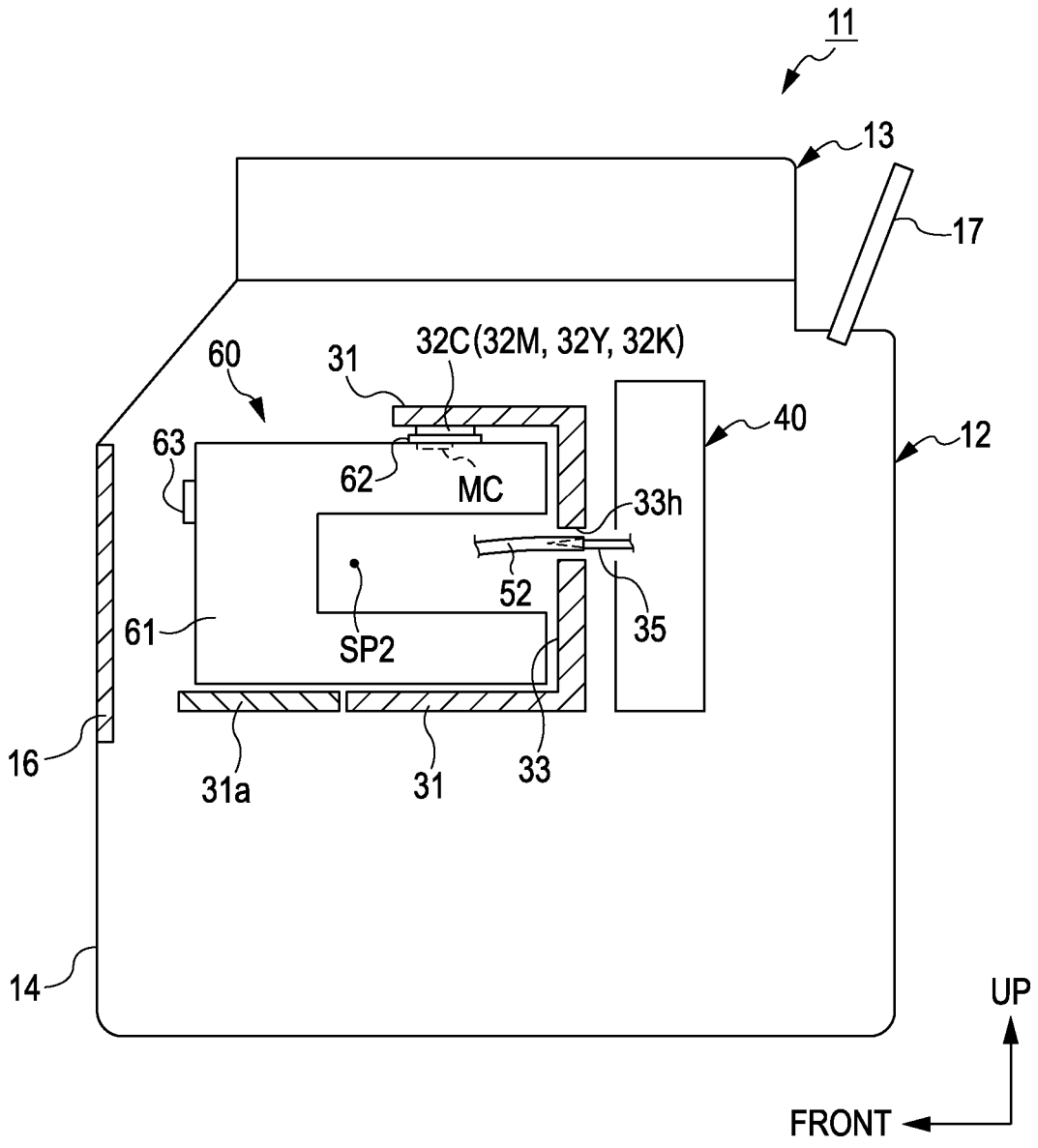
[FIG. 4]

Moreover, in the present embodiment, as illustrated in FIGS. 3 and 4, respective electrical terminals 62C, 62M, 62Y and 62K, which perform the communication between the electrical terminals 32C, 32M, 32Y and 32K and are provided in the circuit board each including the memory cell MC maintaining the information about whether or not the printing operation is possible, are each provided on upper surfaces of the respective adaptor main bodies 61C, 61M, 61Y and 61K. Moreover, as illustrated in FIG. 4, in the state where each adaptor 60 is inserted and mounted with respect to the cartridge holder 31 from the front to the back, the respective electrical terminals 62C, 62M, 62Y and 62K provided on the upper surface of each adaptor 60 are each electrically connected between the respective electrical terminals 32C, 32M, 32Y and 32K of the cartridge holder 31. Thereby, it is possible to perform the communication between the memory cell MC of the circuit board and the control portion of the printer 11 via the respective electrical terminals 62C, 62M, 62Y and 62K. In addition, in the following description, when not discriminating the electrical terminals 62C, 62M, 62Y and 62K, the electrical terminal is called an electrical terminal 62.

Furthermore, in each of the adaptor main bodies 61C, 61M, 61Y and 61K, a front side surface (a front surface) thereof is provided as a main body surface portion, a normal direction of which faces in the detachment direction in which the adaptor main body 61 mounted to the liquid accommodation body mounting portion 30 is detached by the extraction or the like, and on a front surface thereof, an operation button 63 as a displacement member is provided on the front surface. Moreover, by pressing the operation button 63 provided in each adaptor 60 to perform the displacement operation, it is possible to generate the update signal that updates the information about whether or not the printing operation is possible maintained in the memory cell MC of the circuit board to information that permits the printing operation of the printer 11.

The operation of the adaptor 60 configured as above used in the present aspect is as follows.

That is, the adaptor 60 generates the update signal that updates the information about whether or not the printing operation is possible maintained in the memory cell MC of the circuit board to the information permitting the printing operation of the printer 11 by pushing and displacement operation of the operation button 63, and outputs the update signal to the memory cell MC of the circuit board. When the information about whether or not the printing operation is possible maintained in the memory cell MC of the circuit board does not permit the printing operation of the printer 11, the information is suitably updated to the information that permits the printing operation to the printer 11 by the output. As a result, in the printer 11, the printing operation using the consumption portion 20 is permitted and is executed without stopping. Thus, the operation button 63 functions as an update signal output portion that outputs the update signal, which updates the information about whether or not the printing operation is possible maintained in the memory cell MC of the circuit board to the information permitting the printing operation of the printer 11, to the memory cell MC of the circuit board.

Next, the adaptor 60 of the aspect of supplying the ink to the supply needle 35 via the adaptor will be described with reference to FIGS. 5 and 6. In addition, in the description of the present aspect, the same constituents as the configurations illustrated in FIG. 2 are denoted by the same reference numerals, and the descriptions thereof will be omitted.

As illustrated in FIG. 5, the adaptor main body 61 having the adaptors 60C, 60M, 60Y and 60K having a substantially rectangular parallelepiped shape is mounted to the liquid accommodation body mounting portion 30 so as to be replaceable with each ink cartridge 55 (see FIG. 3). In the same manner as when each ink cartridge is mounted, the supply needle 35 is inserted into the supply port 68 (see FIG. 3) provided at the rear side in each adaptor main body 61 of each adaptor 60 when each of the adaptors 60C, 60M, 60Y and 60K is mounted. In addition, in FIG. 5, the adaptors 60C and 60M are illustrated in the state just before being mounted to the liquid accommodation body mounting portion 30, and the adaptors 60Y and 60K are illustrated in the state after being mounted to the liquid accommodation body mounting portion 30. Furthermore, each of the adaptors 60C, 60M, 60Y and 60K is configured so that a shape of a portion inserted into the cartridge holder 31 is formed to be at least substantially the same as the ink cartridge 55.

Moreover, the respective ink supply tubes 52C, 52M, 52Y and 52K connected to the ink tank 50 located outside the apparatus main body 12 are connected to the respective mounted adaptors 60C, 60M, 60Y and 60K in the connection portion 66. Each ink accommodated in the ink tank 50 accommodating the ink of capacity greater than the ink cartridge is supplied to each supply needle 35 from each ink supply tube 52 via each adaptor 60 by the connection.

In this manner, in the aspect of supplying the ink to the supply needle 35 from the ink tank 50 via the adaptor 60, there is also need to be able to communicate between the memory cell MC of the circuit board and the control portion of the printer 11.

Figure 6:
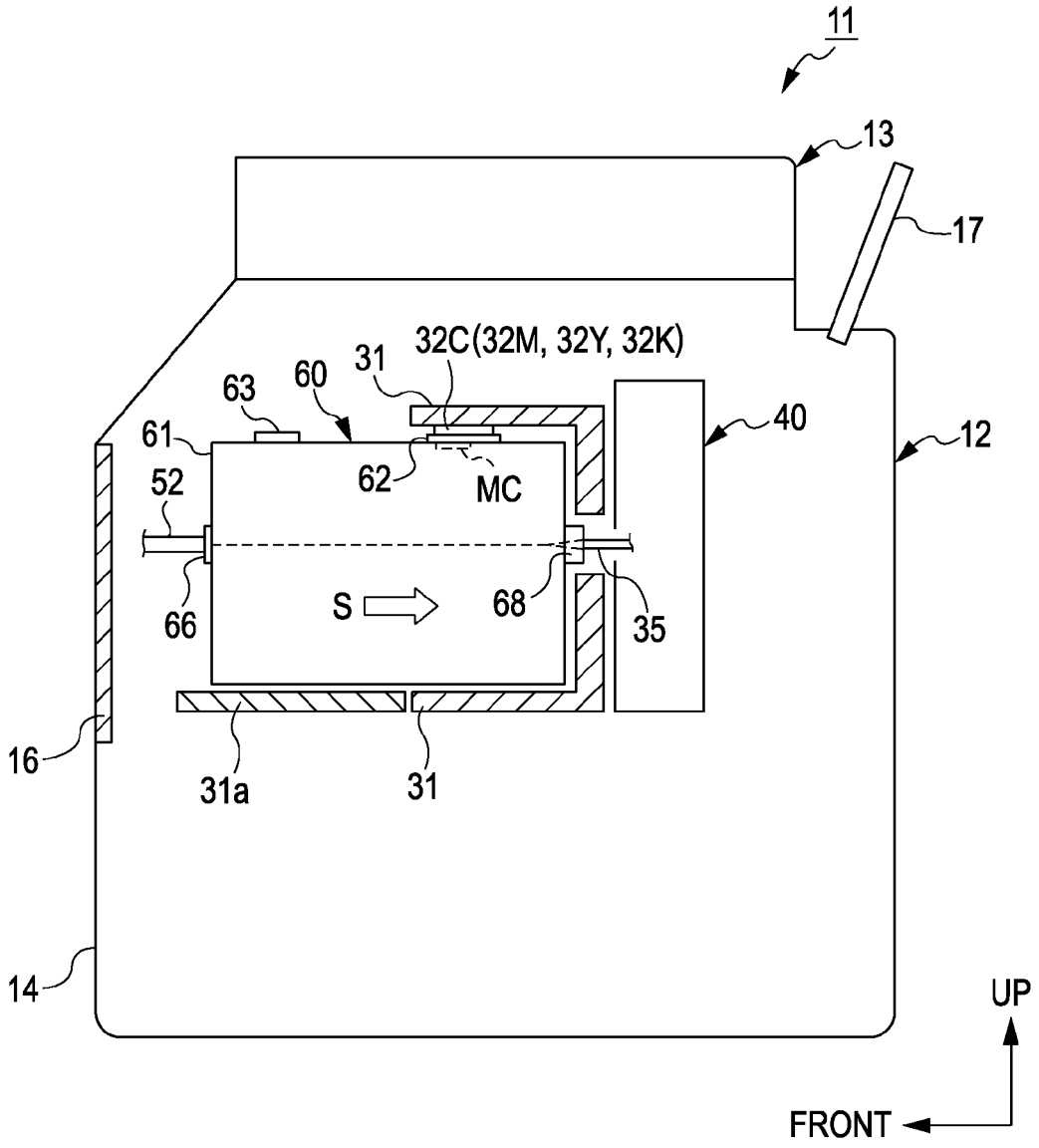
[FIG. 6]

Thus, in the present embodiment, as illustrated in FIGS. 5 and 6, the respective electrical terminals 62C, 62M, 62Y and 62K, which perform the communication between the electrical terminals 32C, 32M, 32Y and 32K and are provided in the circuit board including the memory cell MC maintaining the information about whether or not the printing operation is possible, are provided on the upper surfaces of the respective adaptor main bodies 61C, 61M, 61Y and 61K. Moreover, as illustrated by an arrow S in FIG. 6, the adaptor 60 is inserted into the cartridge holder 31 from the front to the back, and the supply needle 35 is inserted and connected to the supply port 68. In the connected state of the adaptor 60, the respective electrical terminals 62C, 62M, 62Y and 62K provided on the upper surface of each adaptor 60 are electrically connected between the respective electrical terminals 32C, 32M, 32Y and 32K of the cartridge holder 31, and thus the memory cell MC of the circuit board can communicate with the control portion of the printer 11.

Furthermore, on the upper surfaces of the respective adaptor main bodies 61C, 61M, 61Y and 61K, when being mounted to the liquid accommodation body mounting portion 30, at the position at an opposite side in the insertion direction (an arrow S) with respect to the supply port 68 when the adaptor main body 61 is mounted to the liquid accommodation body mounting portion, an operation button 63 as a displacement member is provided. Moreover, the operation button 63 provided in each adaptor 60 may be pressed down and be subjected to the displacement operation. By the displacement operation, the update signal is generated which updates the information about whether or not the printing operation is possible maintained in the memory cell MC of the circuit board to the information permitting the printing operation of the printer 11.

The operation of the adaptor 60 configured as above and used in the aspect is as follows. The update signal is generated which updates the information about whether or not the printing operation is possible maintained in the memory cell MC of the circuit board to the information permitting the printing operation of the printer 11, and the update signal is output to the memory cell MC of the circuit board. When the information about whether or not the printing operation is possible maintained in the memory cell MC of the circuit board does not permit the printing operation of the printer 11, the information is suitably updated to information that permits the printing operation to the printer 11 by the output.

As a result, in the printer 11, the printing operation using the consumption portion 20 is permitted and is executed without stopping. Thus, the operation button 63 functions as an update signal output portion that outputs the update signal, which updates the information about whether or not the printing operation is possible maintained in the memory cell MC of the circuit board to the information permitting the printing operation of the printer 11, to the memory unit MC of the circuit board.

According to the embodiment, the following effects can be obtained.

(1) Since the adaptor main body 61 includes the operation button 63 configured to output the update signal, which updates the information permitting the printing operation of the printer 11, in the printer 11 configured to supply the ink from the ink tank 50, the ejecting operation (the printing operation) of the ink can be performed by the adaptor 60 mounted to the liquid accommodation body mounting portion 30.

(2) Since the operation button 63 is a displacement member that outputs the update signal by the displacement operation, the displacement operation is performed by the simple operation such as pressing the operation button 63, and the ejecting operation of the ink can be performed.

(3) Since the operation button 63 is provided at the position at the opposite side in the insertion direction with respect to the supply port 68 when the adaptor main body 61 is mounted to the liquid accommodation body mounting portion 30, the operation button 63 can be provided at an operable position in the adaptor main body 61 in the state where the adaptor main body 61 is mounted to the liquid accommodation body mounting portion 30.

(4) For example, when a space area is formed at the detachment direction side with respect to the adaptor 60 by opening the front cover 16, by providing the operation button 63 on the front surface in which the normal line faces in the detachment direction, the operation button 63 can be easily operated from the space area.

(5) Since the adaptor main body 61 includes the operation button 63, the ejecting operation of the ink can be performed simply by the adaptor 60 mounted to the liquid accommodation body mounting portion 30. Furthermore, the adaptor 60 is easily handled.

In addition, the above-mentioned embodiment may be changed as follows.

In the above-mentioned embodiment, the adaptor 60 may be used in which a plurality of electrical terminals 62 is provided in one adaptor main body 61. The modified example will be described with reference to FIGS. 7(*a*), (*b*) and (*c*).

Figure 7:
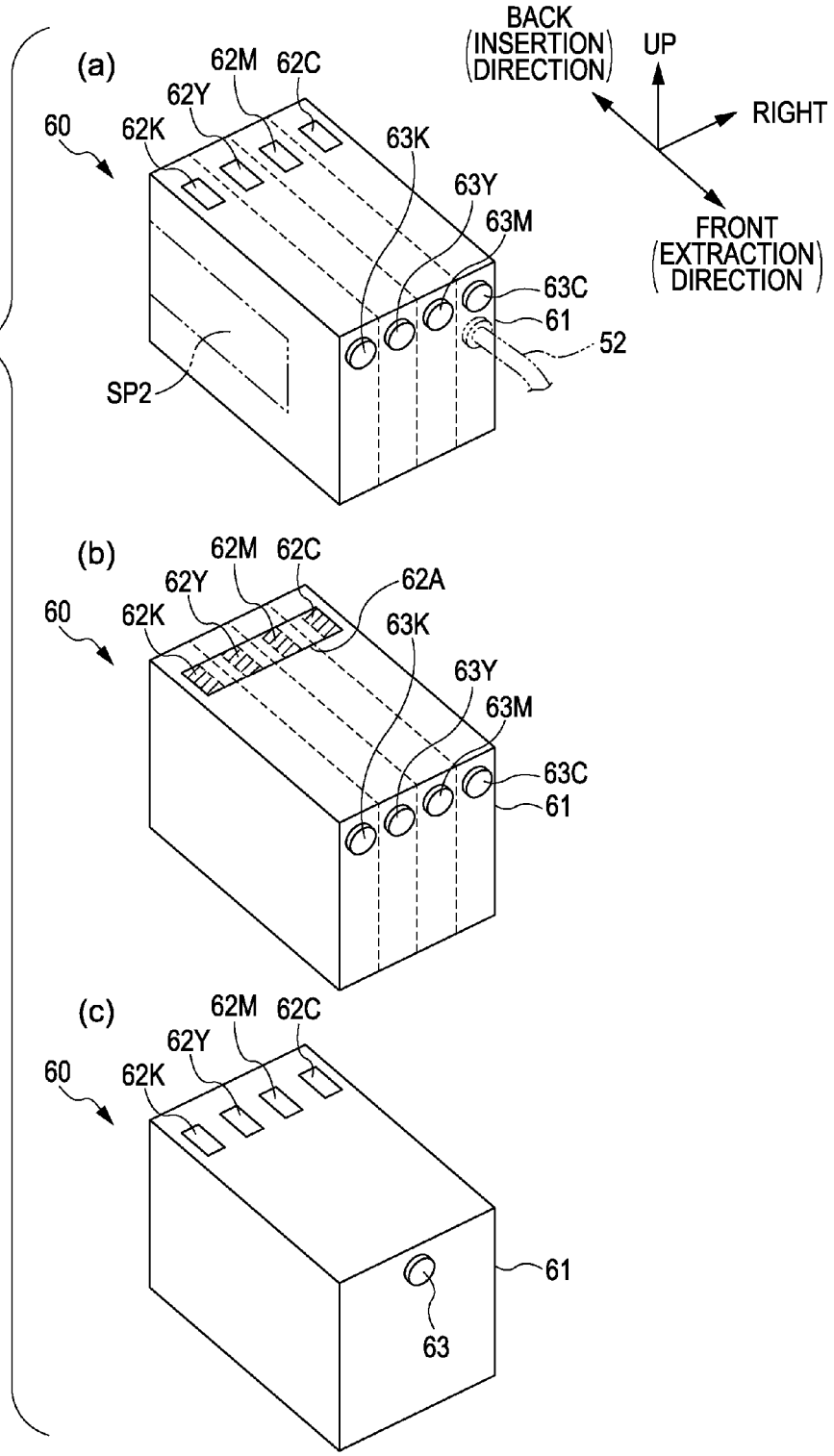
[FIG. 7] FIGS. 7(*a*) to 7(*c*) are modified examples of the adaptor and are perspective views that illustrate an aspect in which a plurality of adaptors is integrated.

As illustrated in FIG. 7(*a*), the adaptor 60 has an adaptor main body 61 formed by the integration of the plural ones (herein, four), and has a configuration in which the inside thereof is partitioned as illustrated by a broken line in the drawings, and four adaptors 60 (60C, 60M, 60Y and 60K) accommodating each ink are united. Moreover, the plurality (herein, four) of electrical terminals 62, that is, the electrical terminals 62C, 62M, 62Y and 62K are provided on the upper surface of the one adaptor main body 61. Furthermore, similarly, on the front surface serving as the detachment direction side of the one adaptor main body 61, operation buttons 63C, 63M, 63Y and 63K are provided for each partition functioning as the adaptors 60C, 60M, 60Y and 60K.

In addition, although the description will be omitted, in a modified example of the adaptor 60 including the present modified example as will be described later, when the ink supply tube 52 is directly connected to the supply needle 35 and the ink is supplied to the supply needle 35, a space portion SP2 is formed in the adaptor main body 61. Furthermore, when the supply needle 35 is supplied with the ink via the adaptor 60, the ink supply tube 52 is connected to a predetermined position (for example, the front side serving as the detachment direction) of the adaptor main body 61.

Furthermore, as illustrated in FIG. 7(*b*), the adaptor 60 of the present modified example may be configured so that the respective electrical terminals 62C, 62M, 62Y and 62K in the adaptor 60 illustrated in FIG. 7(*a*) are formed by one substrate 62A which is formed on the upper surface of the adaptor main body 61. For example, in a sheet of circuit board, the connectable area portion (for example, a pattern-forming area portion) may be separately formed so as to be illustrated by a hatching portion, thereby to form the respective electrical terminals 62C, 62M, 62Y and 62K.

Otherwise, as illustrated in FIG. 7(*c*), the adaptor 60 of the present modified example may be configured so that the respective operation buttons 63C, 63M, 63Y and 63K in the adaptor 60 illustrated in FIG. 7(*a*) are formed by one operation button 63 and are provided on the front surface of the adaptor main body 61.

According to the modified example, the following effects are exhibited in addition to the effects (1) to (5) of the above-mentioned embodiment.

(6) The ejecting operation of the ink can be performed in regard to the ink that is supplied by the plurality of ink cartridges 55 mounted to the printer 11, respectively. Furthermore, since the information of the plurality of memory cells MC can be updated in one adaptor main body 61, the ejecting operation of the ink can be performed in regard to the plurality of inks, by the one adaptor 60.

In the above-mentioned embodiment, in the adaptor 60, the operation button 63 may be provided on the surfaces other than the front surface and the upper surface of the adaptor main body 61. Furthermore, the adaptor 60, in which the plurality of electrical terminals 62 is provided in the adaptor main body 61, may be used. The modified example will be described with reference to FIGS. 8(*a*) to 8(*e*).

Figure 8:
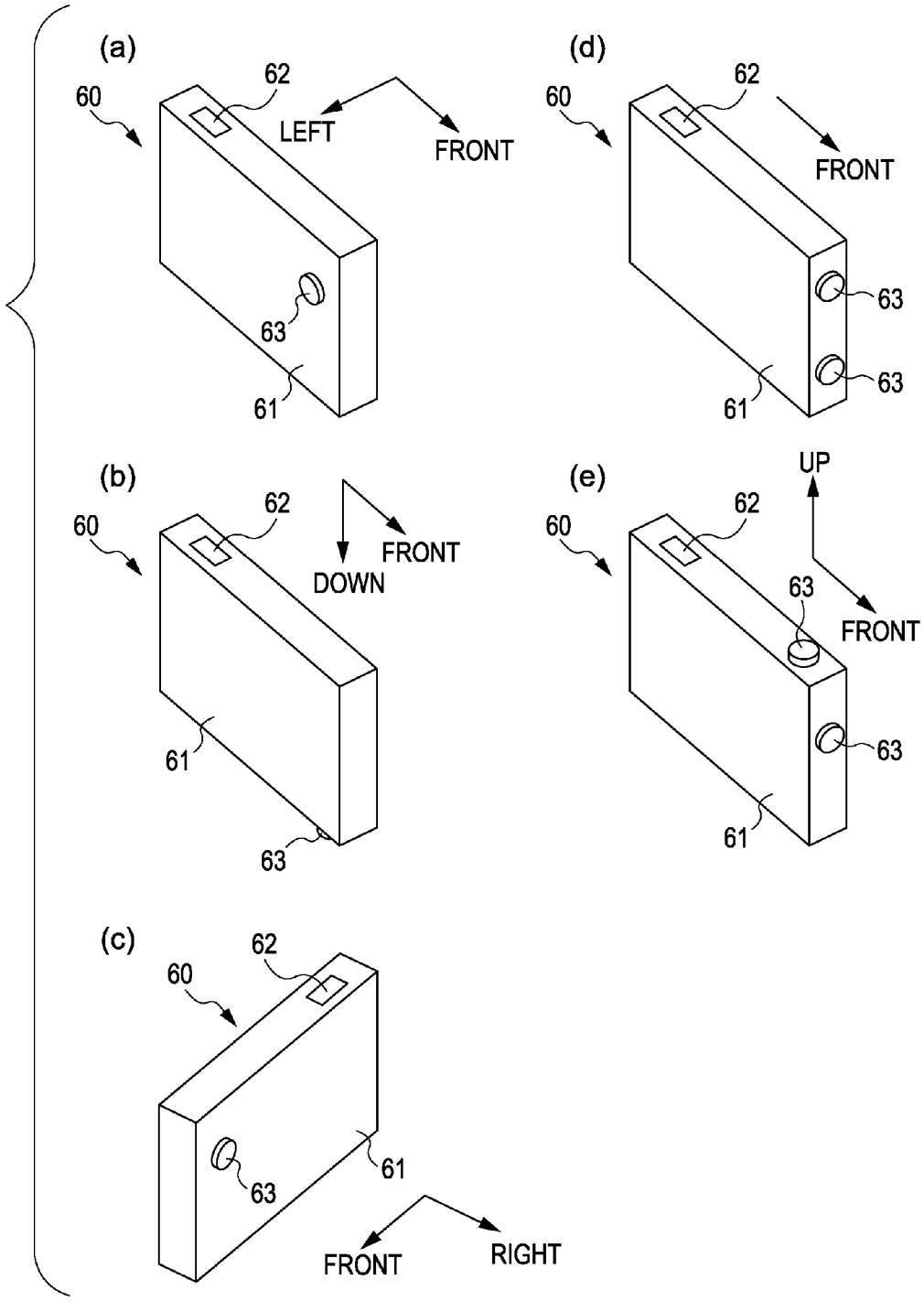
[FIG. 8] FIGS. 8(*a*) to 8(*e*) are modified examples of the adaptor and are perspective views that illustrate an arrangement of an operation button.

As illustrated in FIG. 8(*a*), the adaptor 60 is provided with the operation button 63 on the left side surface (left surface) of the adaptor main body 61 when viewed from the detachment direction. For example, when a gap is present on the left side of the adaptor main body 61 in the adaptor 60 mounted to the cartridge holder 31, it is preferable to provide the operation button 63 in this manner.

Otherwise, as illustrated in FIG. 8(*b*), the adaptor 60 is provided with the operation button 63 on the lower side surface (lower surface) of the adaptor main body 61. For example, when a gap is present on the lower side of the adaptor main body 61 in the adaptor 60 mounted to the cartridge holder 31, it is preferable to provide the operation button 63 in this manner.

Otherwise, as illustrated in FIG. 8(*c*), the adaptor 60 is provided with the operation button 63 on the right side surface (right surface) of the adaptor main body 61 when viewed from the detachment direction. For example, when a gap is present on the right side of the adaptor main body 61 in the adaptor 60 mounted to the cartridge holder 31, it is preferable to provide the operation button 63 in this manner.

In addition, as illustrated in FIG. 8(*d*), the adaptor 60 is provided with a plurality (herein, two) of operation buttons 63 in front of the adaptor main body 61. Thus, both the two operation buttons 63 can be easily operated from the front side serving as the detachment direction.

Otherwise, as illustrated in FIG. 8(*e*), the adaptor 60 is provided with each of one (total two) operation button 63 on the front surface and the upper surface of the adaptor main body 61. For example, in the adaptor 60 mounted to the cartridge holder 31, when a gap is present on the upper side and the front of the adaptor main body 61, it is preferable to provide the operation buttons 63 in this manner.

In addition, in FIGS. 8(*d*) and 8(*e*), the surface on which the operation buttons 63 is provided may be a plurality of surfaces of the adaptor main body 61 including the left surface, the right surface and the lower surface illustrated in FIGS. 8(*a*) to 8(*c*).

According to the present modified example, the following effects are exhibited in addition to the effects (1) to (5) of the above-mentioned embodiment.

(7) In the adaptor main body 61, one of the plurality of operation buttons 63 is selected, for example, by selecting the operation button 63 located at the position in which the button can be pushed, and the ejecting operation of the ink can be performed.

In the above-mentioned embodiment, the adaptor main body 61 is provided with a hollow-shaped portion depressed in a direction intersecting with the detachment direction (the front direction) in which the adaptor main body 61 mounted to the liquid accommodation body mounting portion 30 is detached, and the operation button 63 may be the adaptor 60 provided in the hollow-shaped portion. The modified example will be described with reference to FIGS. 9 and 10(*a*), (*b*) and (*c*).

Figure 9:
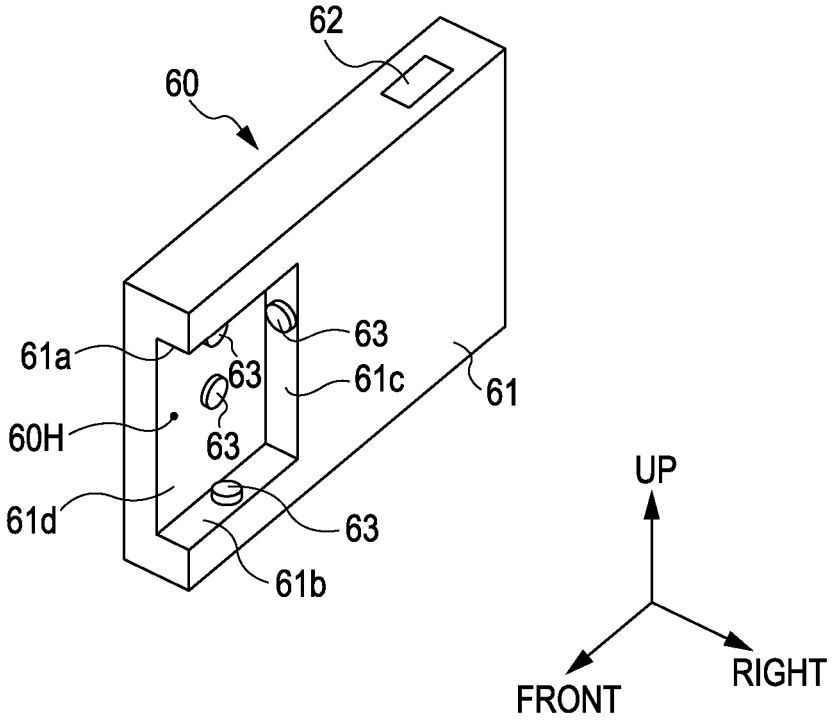
[FIG. 9]

As illustrated in FIG. 9, in the adaptor 60 of the modified example, the hollow-shaped portion 60H depressed in the direction of right to left in the direction intersecting with the front direction serving as the detachment direction is formed in the adaptor main body 61. Moreover, the operation buttons 63 are provided on the respective surfaces of an upper end surface 61*a*, a lower end surface 61*b*, a rear end surface 61*c* and a left end surface 61*d* in the internal space of the formed hollow-shaped portion 60H. In addition, at least one operation button 63 may be provided in the hollow-shaped portion 60H. Furthermore, the hollow-shaped portion 60H may be formed to have at least an opening capable of operating the operation button 63 from the front on the front surface thereof.

Figure 10:
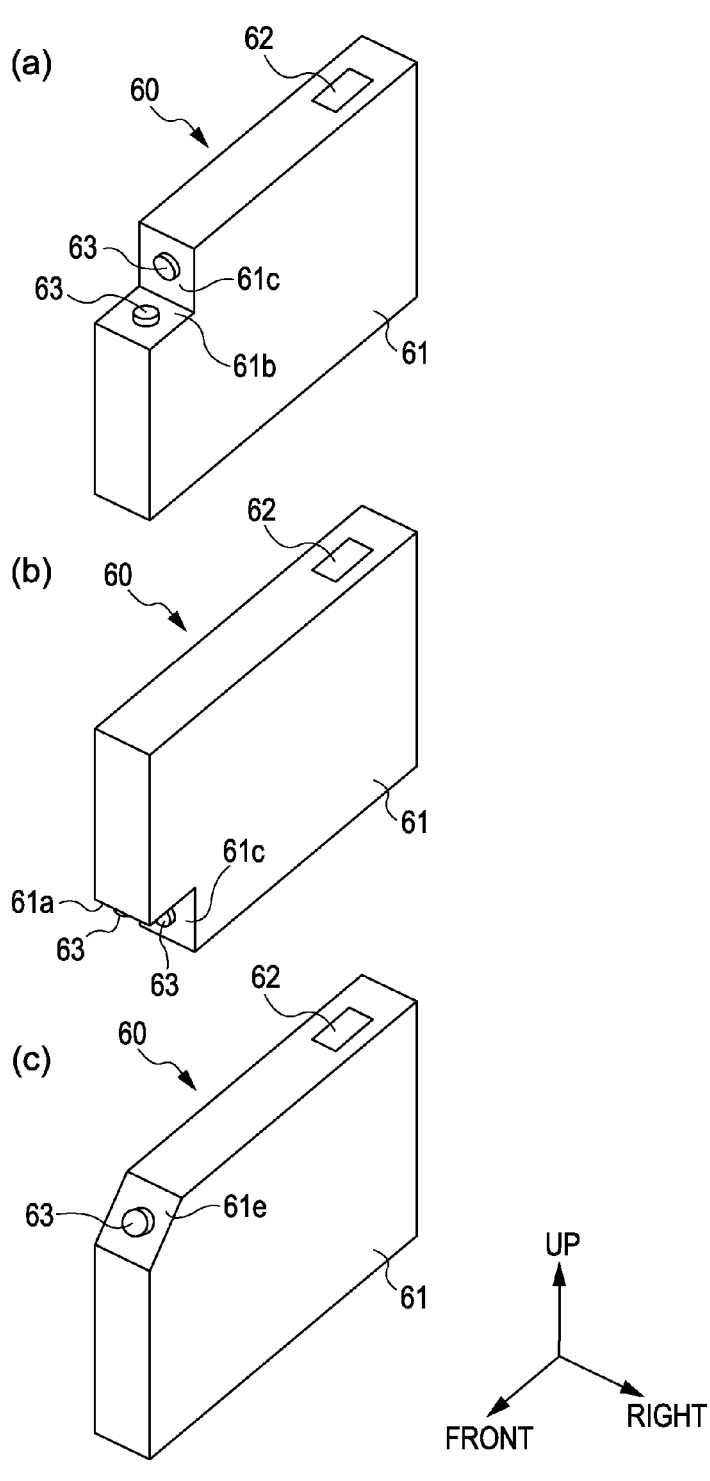
[FIG. 10] FIGS. 10(*a*) to 10(*c*) are modified examples of the adaptor and are perspective views that illustrate a state where the operation button is placed on a surface formed on a detachment direction side.

Furthermore, as illustrated in FIG. 10(*a*), in the adaptor 60 of the present modified example, the hollow-shaped portion depressed in the downward direction from the upper side in the direction intersecting with the front direction serving as the detachment direction is formed so as to cut a corner portion of the front upper end in the adaptor main body 61 in a square shape. That is, as a surface in which the normal direction faces in the detachment direction and which continues to the front surface (the first surface) of the adaptor main body 61 serving as the surface which is the nearest to the detachment direction side when being mounted to the cartridge holder 31, the lower end surface 61*b* (the second surface) is formed in which the normal direction extends in the direction intersecting with the detachment direction from the left and right surfaces of the adaptor main body 61 serving as a pair of facing surfaces facing each other in the direction intersecting with the detachment direction. Furthermore, as a surface continuing to the lower end surface 61*b*, the rear end surface 61*c* (also corresponding to the main body surface portion) is formed in which the normal faces in the detachment direction. Moreover, the operation button 63 is provided on at least one of the formed lower end surface 61*b* and the rear end surface 61*c*.

Furthermore, as illustrated in FIG. 10(*b*), in the adaptor 60 of the present modified example, the hollow-shaped portion depressed in the upward direction from the lower side in the direction intersecting with the front direction serving as the detachment direction is formed so as to cut a corner portion of the front lower end in the adaptor main body 61 in a square shape. That is, as a surface which continues to the front surface (the first surface) of the adaptor main body 61, the upper end surface 61*a* (the second surface) is formed which extends in the direction intersecting with the detachment direction from the left and right surfaces of the adaptor main body 61. Furthermore, as a surface continuing to the upper end surface 61*a*, the rear end surface 61*c* (also corresponding to the main body surface portion) is formed in which the normal faces in the detachment direction. Moreover, the operation button 63 is provided on at least one of the formed upper end surface 61*a* and the rear end surface 61*c*.

Otherwise, as illustrated in FIG. 10(*c*), in the adaptor 60 of the present modified example, the hollow-shaped portion obliquely depressed in the downward direction from the upper side in the direction intersecting with the front direction serving as the detachment direction is formed so as to cut a corner portion of the adaptor main body 61 in a triangular shape. That is, as a surface which continues to the front surface (the first surface) of the adaptor main body 61, a slope surface 61*e* (the second surface) is formed which extends in the direction intersecting with the detachment direction from the left and right surfaces of the adaptor main body 61. Moreover, the operation button 63 is provided on the formed slope surface 61*e*.

According to the present modified example, the following effects are exhibited in addition to the above-mentioned embodiments (1) to (5) and (7).

(8) Since the operation button 63 can be provided, for example, so as not to project from the external form of the adaptor main body 61, in the state where the adaptor 60 is mounted to the liquid accommodation body mounting portion 30, the interference between the adaptors 60 can be suppressed. Furthermore, since the operation button 63 is provided on surface contiguous with the front surface provided on side further away in the detachment direction, the operation button 63 can be easily operated from the detachment direction.

In the above-mentioned embodiment, the operation button 63 may not be necessarily provided in the adaptor main body 61. The present modified example will be described with reference to FIGS. 11(*a*) and 11(*b*).

Figure 11:
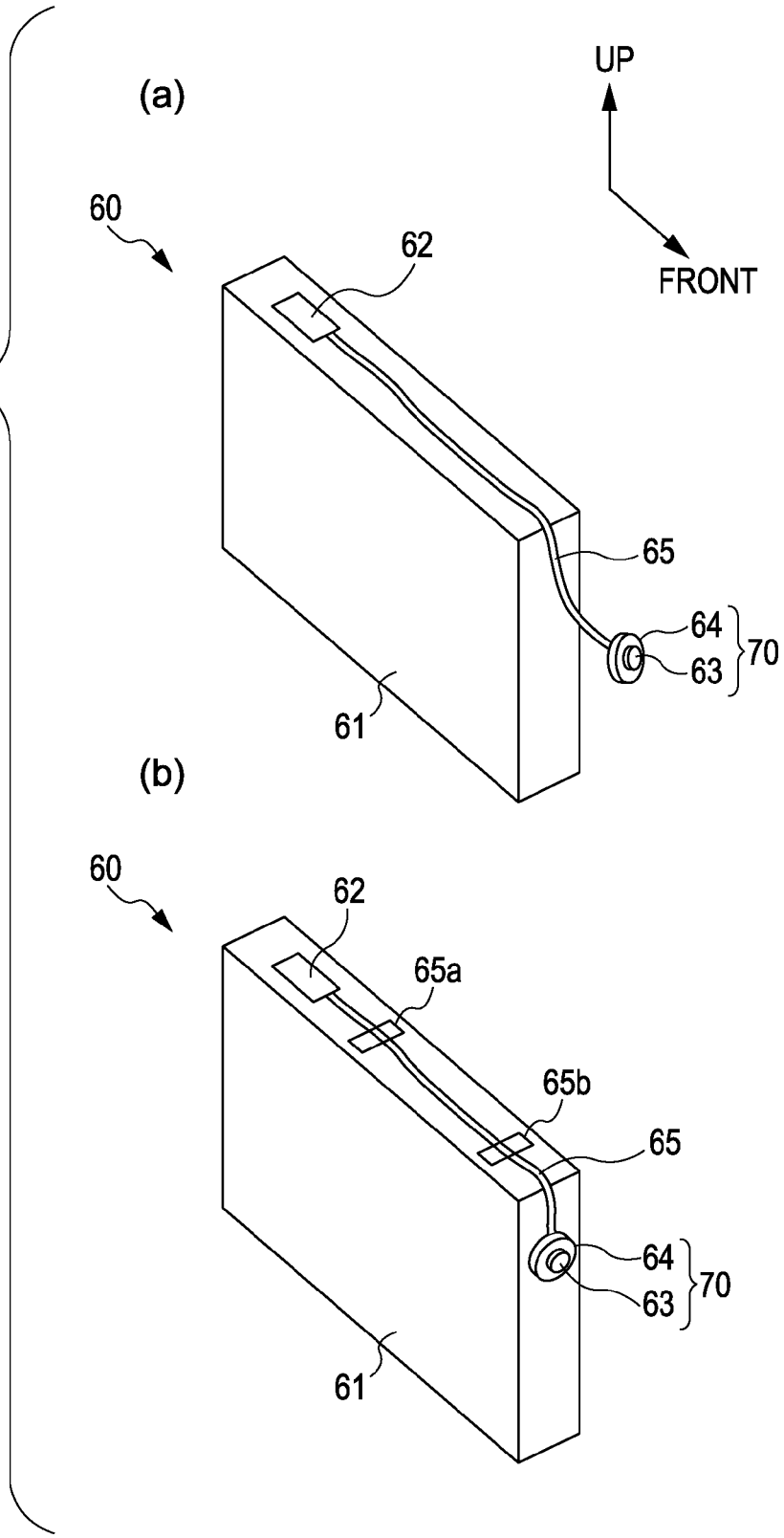
[FIG. 11] FIGS. 11(*a*) and 11(*b*) are modified examples of the adaptor and are perspective views that illustrate a state where the operation button is electrically connected to an electrical terminal by a conductive member.

As illustrated in FIG. 11(*a*), the adaptor 60 of the present modified example is configured so that the operation button 63 is included separately from the adaptor main body 61. That is, the operation button 63 is fixed to the fixing member 64 constituted by a substrate or the like, an operation portion 70 is formed, and the operation portion 70 and the electrical terminal 62 are electrically connected to each other by the conductive member 65. Thus, by pressing the operation button 63, the update signal, which updates the information about whether or not the printing operation is possible maintained in the memory cell MC of the circuit board to the information permitting the printing operation of the printer 11, is output to the memory cell MC. The conductive member 65 is able to detach the operation portion 70 from the adaptor main body 61 by lengthening the length thereof.

According to the present modified example, it is possible to place the operation portion 70 (the operation button 63) at a position separated from the electrical terminal 62 provided in the adaptor 60. Thus, for example, the operation button 63 can be included at a location such as the apparatus main body 12 of the printer 11 allowing easy operation by a user.

In addition, as illustrated in FIG. 11(*b*), in the present modified example in which the operation button 70 (the operation button 63) is included separately from the adaptor main body 61, the operation button 63 provided separately may be fixed to the adaptor main body 61. That is, the operation portion 70 and the conductive member 65 may be adhered to the adaptor main body 61 by adhesion tapes 65*a* and 65*b*, an adhesive (not illustrated) or the like. In this case, as in the above-mentioned embodiment, it can be handled as the adaptor 60 in which the adaptor main body 61 is provided with the operation button 63.

In the above-mentioned embodiment, the displacement member is not necessarily limited to the operation button 63. For example, a part of the adaptor main body 61 may be used as the displacement member. The present modified example will be described with reference to FIG. 12.

Figure 12:
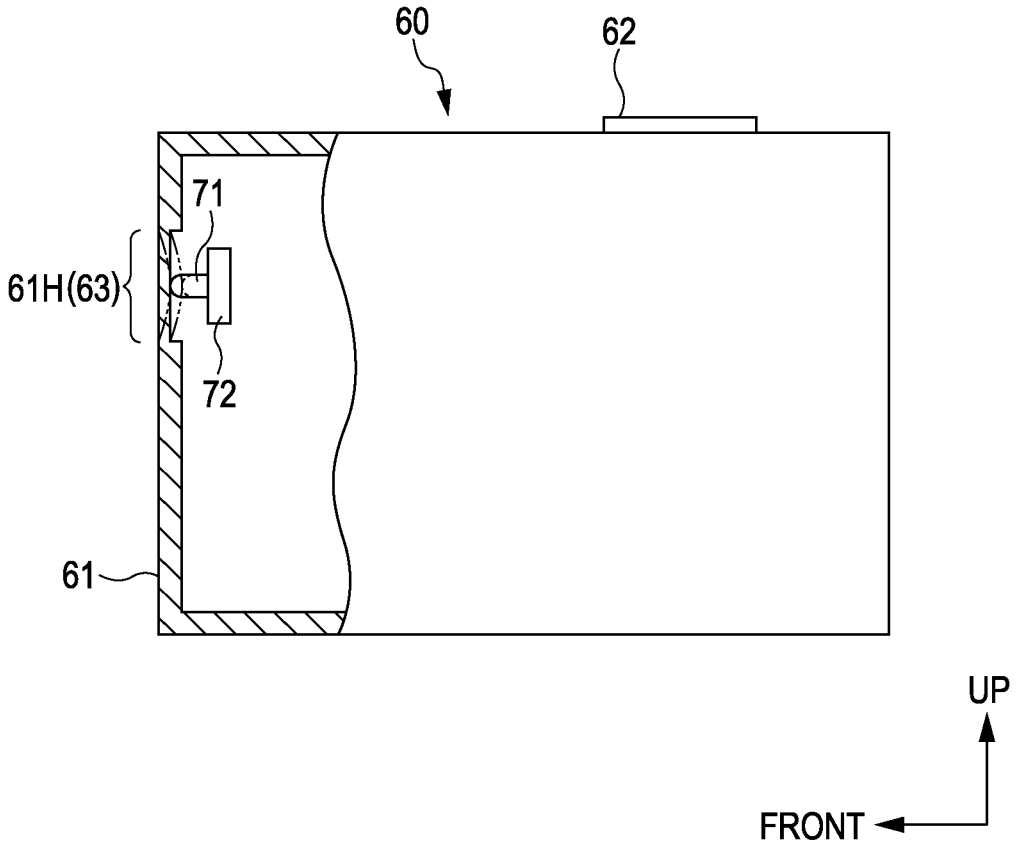
[FIG. 12]

As illustrated in FIG. 12, the adaptor 60 of the present modified example is configured so that a part of the adaptor main body 61 is formed as a thin wall-shaped displacement portion 61H having flexibility. Furthermore, a switch member 72 having an abutment portion 71 abutting against the formed displacement portion 61H from the inside of the adaptor main body 61 is provided in the adaptor main body 61. Moreover, when the displacement portion 61H is displaced as illustrated by a two-dot-chain line in the drawings, the abutment portion 71 is displaced rearward along with the displacement, the switch member 72 is operated, and the update signal is output to the memory cell MC.

As a result, in the present modified example, since the displacement portion 61H can function as the operation button 63 in the above-mentioned embodiment, it is possible to output the update signal, which updates the information about whether or not the printing operation is possible maintained in the memory cell MC, to the memory cell MC so as to permit the ejecting operation of the ink without including the operation button 63.

In the above-mentioned embodiment, the adaptor main body 61 may be provided with at least an opening portion opened in the detachment direction in which the adaptor main body 61 mounted to the liquid accommodation body mounting portion 30 is detached, and the update signal output portion may be provided in the opening portion. The present modified example will be described with reference to FIGS. 13(*a*) and 13(*b*).

Figure 13:
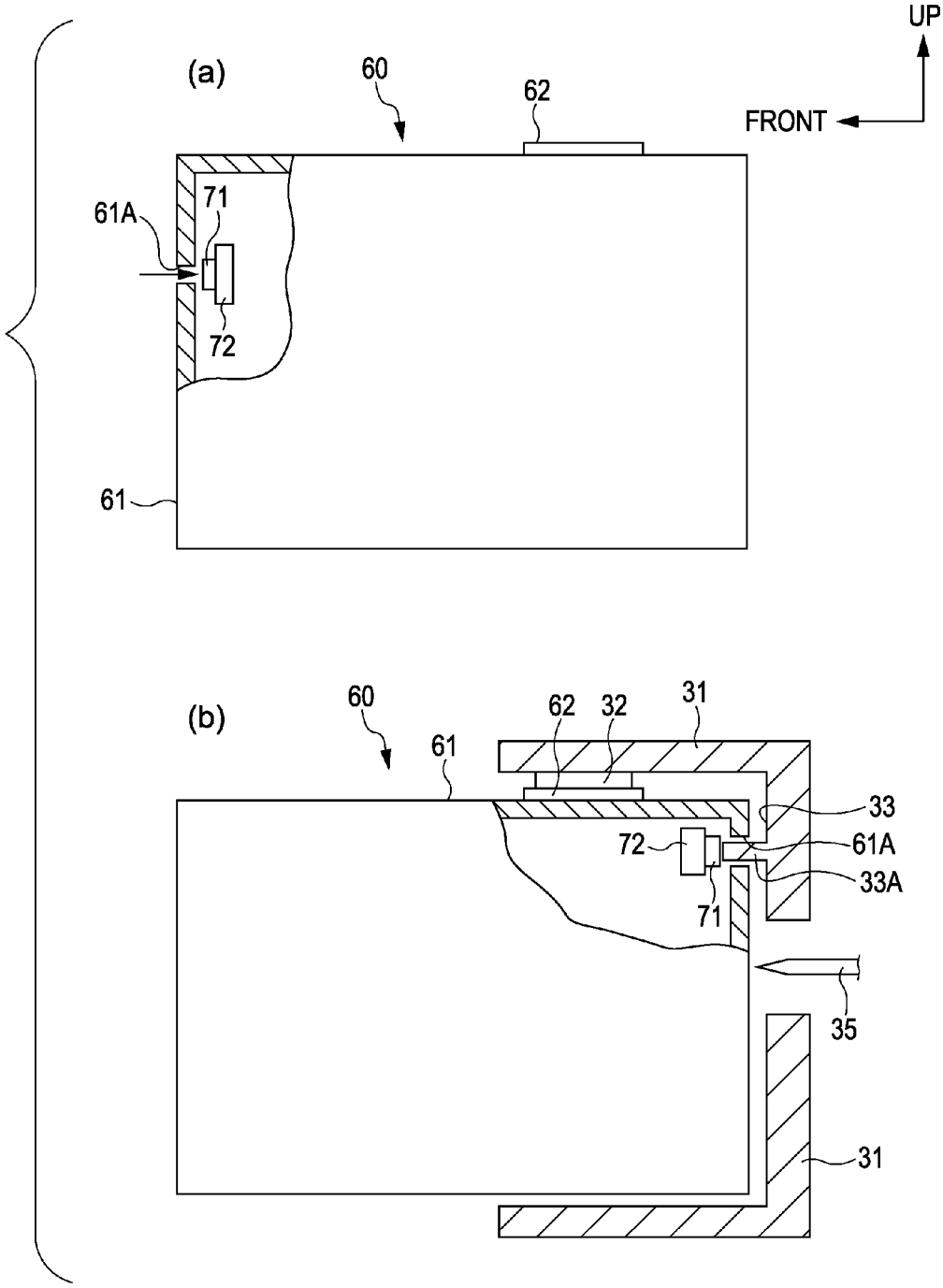
[FIG. 13] FIGS. 13(*a*) and 13(*b*) are modified examples of the adaptor and are cross-sectional views that illustrate a state where the update signal output portion is a displacement member capable of being operated from a through hole provided in the adaptor main body.

As illustrated in FIG. 13(*a*), the adaptor 60 of the present modified example is provided with an opening portion 61A serving as a through hole penetrating to the inside of the adaptor main body 61 on the front surface serving as the detachment direction side. Furthermore, on the inside of the adaptor main body 61, a switch member 72 including an abutment portion 71 as a displacement member subjected to the displacement operation is provided in the adaptor main body 61, at a position overlapping the formed opening portion 61A when viewed from the front.

In the present modified example, the switch member 72 including the abutment portion 71 functions as the update signal output portion. That is, when the member is inserted into the opening portion 61A from the front and the abutment portion 71 is pushed rearward and displaced, the switch member 72 is operated along with the rearward displacement of the abutment portion 71, and a predetermined signal (an update signal) is output from the electrical terminal 62. Thus, according to the present modified example, it is possible to easily operate the update signal output portion from the space area formed at the detachment direction side via the opening portion 61A.

Otherwise, as illustrated in FIG. 13(*b*), the adaptor 60 of the present modified example is provided with an opening portion 61A serving as a through hole penetrating to the inside of the adaptor main body 61 on the rear surface serving as the insertion direction side. Furthermore, on the inside of the adaptor main body 61, a switch member 72 including an abutment portion 71 as a displacement member subjected to the displacement operation is provided in the adaptor main body 61, at a position overlapping the formed opening portion 61A when viewed from the front.

In the present modified example, the switch member 72 including the abutment portion 71 functions as the update signal output portion. That is, when inserting the adaptor main body 61 to the cartridge holder 31, for example, a forward projecting projection portion 33A provided in the rear wall 33 in the space area SP1 is inserted into the opening portion 61A. Moreover, when the abutment portion 71 is relatively pushed forward and displaced by the projection portion 33A by further pressing the adaptor main body 61 rearward by a predetermined amount, the switch member 72 is operated along with the forward displacement of the abutment portion 71, and a predetermined signal (update signal) is output from the electrical terminal 62. Thus, according to the present modified example, it is possible to operate the update signal output portion by the displacement operation such as pressing the adaptor main body 61, without providing the operation button 63 in the adaptor main body 61.

In the above-mentioned embodiment, for example, the ink tank 50 can be provided inside the apparatus case 14, and is not necessarily limited to a configuration of provision outside the apparatus case 14.

In the above-mentioned embodiment, the medium is not limited to the paper P, but may be a plate-shaped member that uses a metallic plate, a resin plate, cloth or the like as a material. That is, members capable of being transported and printed by the ink consumed by the consumption portion 20 may be adopted as the medium.

In the above-mentioned embodiment, the consumption portion 20 is not limited to a serial type printer in which the liquid ejecting head 22 reciprocates along with the carriage 21, but may be a line head type printer capable of performing printing of a paper maximum width range even while the liquid ejecting head 22 is fixed.

In the above-mentioned embodiment, the printer 11 may be an apparatus not including the scanner unit 13, and may be a multi-function printer including the function of a FAX device, a copier device or the like together with the consumption portion 20.

In the above-mentioned embodiment, although the liquid ejecting apparatus has been embodied as the ink jet type printer 11 including the liquid ejecting head configured to eject the ink, the liquid ejecting apparatus may be embodied as a fluid ejecting device that ejects or discharges other fluids other than ink. It is possible to utilize various liquid ejecting apparatuses that include a liquid ejecting head or the like configured to discharge a minute amount of liquid droplets. In addition, the liquid droplet refers to a liquid state that is discharged from the liquid ejecting apparatus, and also includes one leaving traces in a granular shape, a tear shape, and a filiform shape. Furthermore, liquid described herein may be a material capable of being ejected from the liquid ejecting apparatus. For example, the material may include a state when a substance is a liquid phase, and includes a liquid state having high or low viscosity, sol, gel, water, other inorganic solvents, an organic solvent, a solution, and a liquid phase resin, a flow regime like a liquid phase metal (a metallic melt), substance in which one phase is a liquid, as well as material in which particles of a functional material formed of solid bodies such as pigment and metallic particles are dissolved, dispersed or mixed into the solvent or the like. Furthermore, as a typical example of liquid, there is ink, liquid crystal, or the like as described in the above-mentioned embodiment. Herein, ink includes various liquid compositions such as a general water-based ink, an oil-based ink, gel ink, and hot-melt ink. As a specific example of the liquid ejecting apparatus, for example, there is a liquid ejecting apparatus which ejects liquid including materials such as an electrode material and a color material that are used in manufacturing a liquid crystal display, an EL (electroluminescence) display, a surface emitting display, and a color filter in the form of dispersion or dissolution. Otherwise, it may be possible to adopt a liquid ejecting apparatus which ejects biological organic matter used in manufacturing a bio chip, a liquid ejecting apparatus which is used as a precision pipette and ejects liquid serving as a sample, a printing device, a micro dispenser or the like. In addition, it may be possible to adopt a liquid ejecting apparatus which pinpoint-ejects lubricant oil to a precision machine such as a watch and a camera, a liquid ejecting apparatus which ejects transparent resin liquid such as an ultraviolet curing resin onto a substrate so as to form a micro hemispherical lens (an optical lens) or the like used in an optical communication element or the like, a liquid ejecting apparatus which ejects etching liquid such as acid or alkali so as to etch a substrate or the like. Furthermore, the present invention can be applied to any one kind of these liquid ejecting apparatus.

REFERENCE SIGNS LIST

11: printer as liquid ejecting apparatus
20: consumption portion
30: liquid accommodation body mounting portion
32C, 32K, 32M, 32Y: electrical terminals
35: supply needle as supply member
60, 60C, 60K, 60M, 60Y: adaptor
60H: hollow-shaped portion
61, 61C, 61M, 61Y, 61K: adaptor main body
61A: opening portion
62, 62C, 62K, 62M, 62Y: electrical terminal
63: operation button as update signal output portion
68: supply port
MC: memory cell

The invention claimed is:

1. An adaptor comprising:

an adaptor main body capable of being mounted with respect to a liquid accommodation body mounting portion of a liquid ejecting apparatus;

a memory cell that is provided in the adaptor main body, is updated by an update signal output portion, and maintains information about whether a printing operation is possible in the liquid ejecting apparatus;

an electrical terminal that is used in communication between the memory cell and the liquid ejecting apparatus; and the update signal output portion that outputs an update signal to the electrical terminal, the electrical terminal being configured to update the information maintained in the memory cell about whether the printing operation is possible based on the update signal;

wherein the update signal is configured to permit the printing operation of the liquid ejecting apparatus even when the information maintained in the memory cell prior to receiving the update signal does not permit the printing operation of the liquid ejecting apparatus, and wherein the update signal output portion includes a displacement member configured to initiate output of the update signal.

2. The adaptor according to claim 1, wherein a plurality of liquid accommodation bodies are mounted to the liquid ejecting apparatus in an attachable or detachable manner, and wherein the electrical terminal comprises a plurality of electrical terminals, each liquid accommodation body having an electrical terminal of the plurality of electrical terminals.

3. The adaptor according to claim 1, wherein the electrical terminal is associated with one liquid accommodation body, and wherein the update signal output portion comprises a plurality of update signal output portions, the plurality of update signal output portions being associated with the electrical terminal.

4. The adaptor according to claim 1, wherein the update signal output portion is provided in the adaptor main body.

5. The adaptor according to claim 4, wherein the adaptor main body is provided with a supply port that supplies liquid to a supply member containing liquid from the liquid accommodation body when the liquid accommodation body is mounted to the liquid accommodation body mounting portion, and the update signal output portion is located on an opposite side from the supply port an insertion direction when the adaptor main body is mounted to the liquid accommodation body mounting portion.

6. The adaptor according to claim 4, wherein the adaptor main body is provided with a hollow-shaped portion that is depressed in a direction intersecting with a detachment direction, the detachment direction being the direction in which the adaptor main body is detached from the liquid accommodation body mounting portion, and wherein the update signal output portion is provided in the hollow-shaped portion.

7. The adaptor according to claim 4, wherein the adaptor main body is provided with a main body surface portion, a normal direction of which faces in a detachment direction, the detachment direction being the direction in which the adaptor main body is detached from the liquid accommodation body mounting portion, and wherein the update signal output portion is provided in the main body surface portion.

8. The adaptor according to claim 4, wherein the adaptor main body has a first surface and a second surface, wherein a normal direction of the first surface faces in the detachment direction, the detachment direction being the direction in which the adaptor main body is detached from the liquid accommodation body mounting portion, and the first surface is the nearest surface to the detachment direction side when the adaptor main body is mounted to the liquid accommodation body mounting portion, wherein the second surface continues to the first surface, and a normal direction of the second surface extends from a set of facing surfaces in a direction intersecting with the detachment direction, and the update signal output portion is provided on the second surface.

9. The adaptor according to claim 4, wherein the adaptor main body is provided with at least an opening portion that is opened in a detachment direction, the detachment direction being the direction in which the adaptor main body is detached from the liquid accommodation body mounting portion, and the update signal output portion is provided in the opening portion.

10. The adaptor according to claim 1, wherein the adaptor main body has a through hole, and a liquid supply tube connected to a liquid accommodation body provided outside the adaptor main body is disposed in the through hole.

11. The adaptor according to claim 10, wherein the liquid supply tube is connected to the liquid accommodation body via a connection terminal.

12. An adaptor comprising:

an adaptor main body capable of being mounted with respect to a liquid accommodation body mounting portion of a liquid ejecting apparatus;

an electrical terminal provided on the adaptor main body;

a conductive member electrically connected to the electrical terminal; and an operation portion electrically connected to the conductive member, the operation portion being configured to initiate output of an update signal, wherein the update signal is configured to update information maintained in a memory cell that is in communication with the electrical terminal, and wherein the information relates to whether a printing operation is possible.

13. The adaptor according to claim 12, wherein the operation portion is separate from the adaptor main body.

14. The adaptor according to claim 12, wherein the operation portion includes an operation button.

15. The adaptor according to claim 12, wherein the conductive member is coupled to the adaptor main body.

16. The adaptor according to claim 15, wherein the conductive member is adhered to the adaptor main body.

* * * * *